US006786304B2

(12) United States Patent
Utsunomiya et al.

(10) Patent No.: US 6,786,304 B2
(45) Date of Patent: Sep. 7, 2004

(54) GUIDE FOR ELEVATOR

(75) Inventors: Kenji Utsunomiya, Tokyo (JP); Kenichi Okamoto, Tokyo (JP); Takashi Yumura, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 91 days.

(21) Appl. No.: 10/275,488

(22) PCT Filed: Apr. 10, 2001

(86) PCT No.: PCT/JP01/03081

§ 371 (c)(1),
(2), (4) Date: Nov. 6, 2002

(87) PCT Pub. No.: WO02/083543

PCT Pub. Date: Oct. 24, 2002

(65) Prior Publication Data

US 2003/0111302 A1 Jun. 19, 2003

(51) Int. Cl.[7] ..... B66B 1/34
(52) U.S. Cl. ..... 187/292; 187/393; 187/409
(58) Field of Search ..... 187/292, 409, 187/391–394; 361/143, 144, 146, 152, 154

(56) References Cited

U.S. PATENT DOCUMENTS 4,271,931 A * 6/1981 Watanabe ..... 187/292
4,337,848 A * 7/1982 Kindler ..... 187/292
5,652,414 A * 7/1997 Roberts et al. ..... 187/292
5,814,774 A * 9/1998 Remmers et al. ..... 187/292
5,929,399 A * 7/1999 Jamieson et al. ..... 187/391
6,351,096 B1 * 2/2002 Jang ..... 318/811
6,401,872 B1 * 6/2002 Morishita ..... 187/292
6,408,987 B2 * 6/2002 Morishita ..... 187/292
2002/0179377 A1 * 12/2002 Higaki et al. ..... 187/292
2003/0192745 A1 * 10/2003 Utsunomiya et al. ..... 187/292
2003/0226717 A1 * 12/2003 Husmann ..... 187/292

FOREIGN PATENT DOCUMENTS

| | | | |
|---|---|---|---|
| GB | 2 262 932 | 7/1998 | |
| JP | 61236388 A | * 10/1986 | ..... H02P/7/63 |
| JP | 5-186162 | 7/1993 | |
| JP | 8-26624 | 1/1996 | |
| JP | 9-25073 | 1/1997 | |

* cited by examiner

*Primary Examiner*—Jonathan Salata
(74) *Attorney, Agent, or Firm*—Leydig, Voit & Mayer, Ltd

(57) ABSTRACT

A guide device for an elevator in which a pair of corresponding actuators are controlled by controllers in accordance with information from acceleration sensors, and the force with which guide members are pressed against guide rails is adjusted. Each controller includes a current amplification device and diodes. The diodes selectively output signals from the current amplification device to the pair of actuators.

6 Claims, 13 Drawing Sheets

GUIDE FOR ELEVATOR

TECHNICAL FIELD

This invention relates to a guide device for guiding a car along guide rails provided in a hoistway and, in particular, to a guide device for an elevator capable of restraining horizontal vibrations of a car.

BACKGROUND ART

FIG. 15 is a front view of a main portion of a conventional elevator as disclosed, for example, in JP 8-26624 A, and FIG. 16 is a plan view of the elevator of FIG. 15.

Referring to the drawings, a pair of guide rails 2 with a T-shaped section are arranged in parallel in a hoistway 1. A car 3 is suspended in the hoistway 1 by a main cable (not shown), and is raised and lowered along the guide rails 2 by a drive device (not shown).

The car 3 has a car frame 4, a cab 5 supported by the car frame 4, and a plurality of rubber vibration isolators 6 arranged between the car frame 4 and the cab 5. A car door 7 is provided in the cab 5. Further, a control board 8 is mounted in the cab 5.

First, second, and third acceleration sensors 9*a*, 9*b*, and 9*c* are mounted on the upper end portion of the car frame 4. Fourth, fifth, and sixth acceleration sensors 9*d*, 9*e*, and 9*f* are mounted on the lower end portion of the car frame 4. Vibration of the car frame 4 in the direction of the width of the car 3 (the Y-axis direction) is detected by the first and fourth acceleration sensors 9*a* and 9*d* mounted at the center of the car frame 4. Vibration in the direction of the depth of the car 3 (the Z-axis direction) is detected by the second, third, fifth, and sixth acceleration sensors 9*b*, 9*c*, 9*e*, and 9*f* arranged on either side of the first and fourth acceleration sensors 9*a* and 9*d*.

The guide rails 2 have installation-mounting portions 2*a* fixed to the walls (not shown) of the hoistway 1 and guide portions 2*b* extending perpendicularly from the installation-mounting portions 2*a*. Each guide portion 2*b* has first and second guide surfaces 2*c* and 2*d* for guiding the car 3 with respect to the depth direction and a third guide surface 2*e* for guiding the car 3 with respect to the width direction.

At each of the four corners of the car frame 4, there is mounted a roller guide main body 10 engaged with the first, second, and third guide surfaces 2*c*, 2*d*, and 2*e*. Each roller guide main body 10 has a first roller 11*a* rolling on the first guide surface 2*c*, a second roller 11*b* rolling on the second guide surface 2*d*, a third roller 11*c* rolling on the third guide surface 2*e*, and a plurality of springs 12 for pressing the first, second, and third rollers 11 a, 11*b*, and 11*c* against the first, second, and third guide surfaces 2*c*, 2*d*, and 2*e*.

Further, mounted on each roller guide main body 10 are first, second, and third actuators 13*a*, 13*b*, and 13*c* for adjusting the force with which the first, second, and third rollers 11*a*, 11*b*, and 11*c* are pressed against the guide rail 2 by generating electromagnetic forces with respect to the guide rail 2.

FIG. 17 is a circuit diagram showing a part of the circuits in a control board 8 of FIG. 15. Detection signals from the first through sixth acceleration sensors 9*a* through 9*f* are processed by first, second, third, fourth, fifth, and sixth controllers 14*a*, 14*b*, 14*c*, 14*d*, 14*e*, and 14*f* in the control board 8. The actuators 13*a*, 13*b*, and 13*c* are controlled by corresponding controllers 14*a* through 14*f*.

Each of the controllers 14*a* through 14*f* has a signal processing circuit 15, a phase inverter 16, and a pair of current amplification devices 17*a* and 17*b*. The signal processing circuits 15 receive detection signals from the acceleration sensors 9*a* through 9*f* and perform computation processing for restraining acceleration and outputting processing signals. The current amplification devices 17*a* and 17*b* amplify/adjust signals from the signal processing circuits 15 and output them to the actuators 13*a* through 13*c*. Each phase inverter 16 is connected between the signal processing circuit 15 and one current amplification device 17*b*.

Next, the operation of the device will be described. When horizontal vibrations are generated in the car frame 4 during traveling of the car 3, the acceleration of the vibrations are detected by the acceleration sensors 9*a* through 9*f*. The detection signals are processed by the controllers 14*a* through 14*f*, and the actuators 13*a* through 13*c* are controlled so as to cancel the acceleration.

Regarding the vibration component in the direction of the width of the car 3, the acceleration is detected by the first and fourth acceleration sensors 9*a* and 9*d*, and the detection signals are processed by the controllers 14*a* and 14*d*, the acceleration being canceled by the actuators 13*c*.

Regarding the vibration component in the direction of the depth of the car 3, the acceleration is detected by the second, third, fifth, and sixth acceleration sensors 9*b*, 9*c*, 9*e*, and 9*f*, and the detection signals are processed by the controllers 14*b*, 14*c*, 14*e*, and 14*f*, the acceleration being canceled by the actuators 13*a* and 13*b*.

The trouble with the above-described conventional elevator is that a pair of expensive current amplification devices 17*a* and 17*b*, composed of a large number of various parts, are provided in each of the controllers 14*a* through 14*f*, with the result that the number of current amplification devices is large and that the control board 8 is expensive.

DISCLOSURE OF THE INVENTION

The present invention has been made with a view toward solving the above problem in the prior art. It is an object of the present invention to provide an inexpensive guide device for an elevator which is superior in restraining horizontal vibrations of the car.

In accordance with this invention, there is provided a guide device for an elevator, which is engaged with a pair of guide rails each having first and second guide surfaces for guiding a car in a car depth direction and a third guide surface for guiding the car in a car width direction and which is adapted to guide the traveling of the car, the guide device comprising: a plurality of guide members mounted in the car and abutting the first through third guide surfaces; a plurality of urging means provided between the car and the guide members and adapted to press the guide members against the guide rails; a plurality of actuators mounted in the car and adapted to adjust the force with which the guide members are pressed against the guide rails; a plurality of acceleration sensors mounted in the car and adapted to detect accelerations in the depth direction and the width direction of the car; and a plurality of controllers for respectively controlling pairs of actuators reversing the force applied to the guide members in accordance with information from the acceleration sensors, wherein each controller has: a signal processing circuit for receiving detection signals from one of the acceleration sensors and adapted to perform computation processing for restraining any acceleration generated in the car; a current amplification device for amplifying/adjusting signals from the signal processing circuit; and a plurality of diodes respectively provided between the current amplification device and one of the pairs of actuators and adapted to selectively output signals from the current amplification device to the pair of actuators.

BEST MODE FOR CARRYING OUT THE INVENTION

Preferred embodiments of this invention will now be described with reference to the drawings.

Embodiment 1

Figure 1:
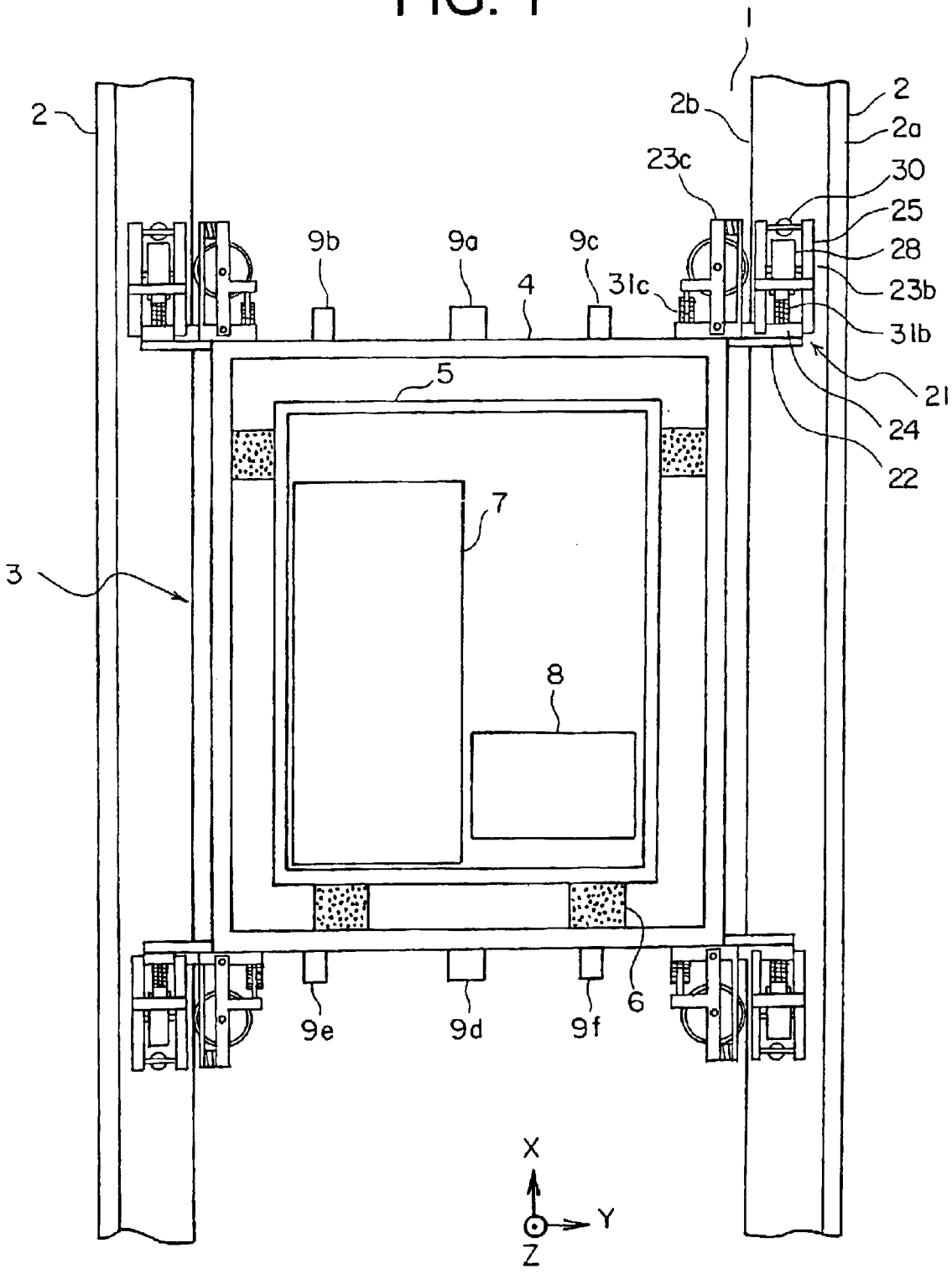
FIG. 1 is a front view of a main portion of an elevator according to Embodiment 1 of this invention.
Figure 2:
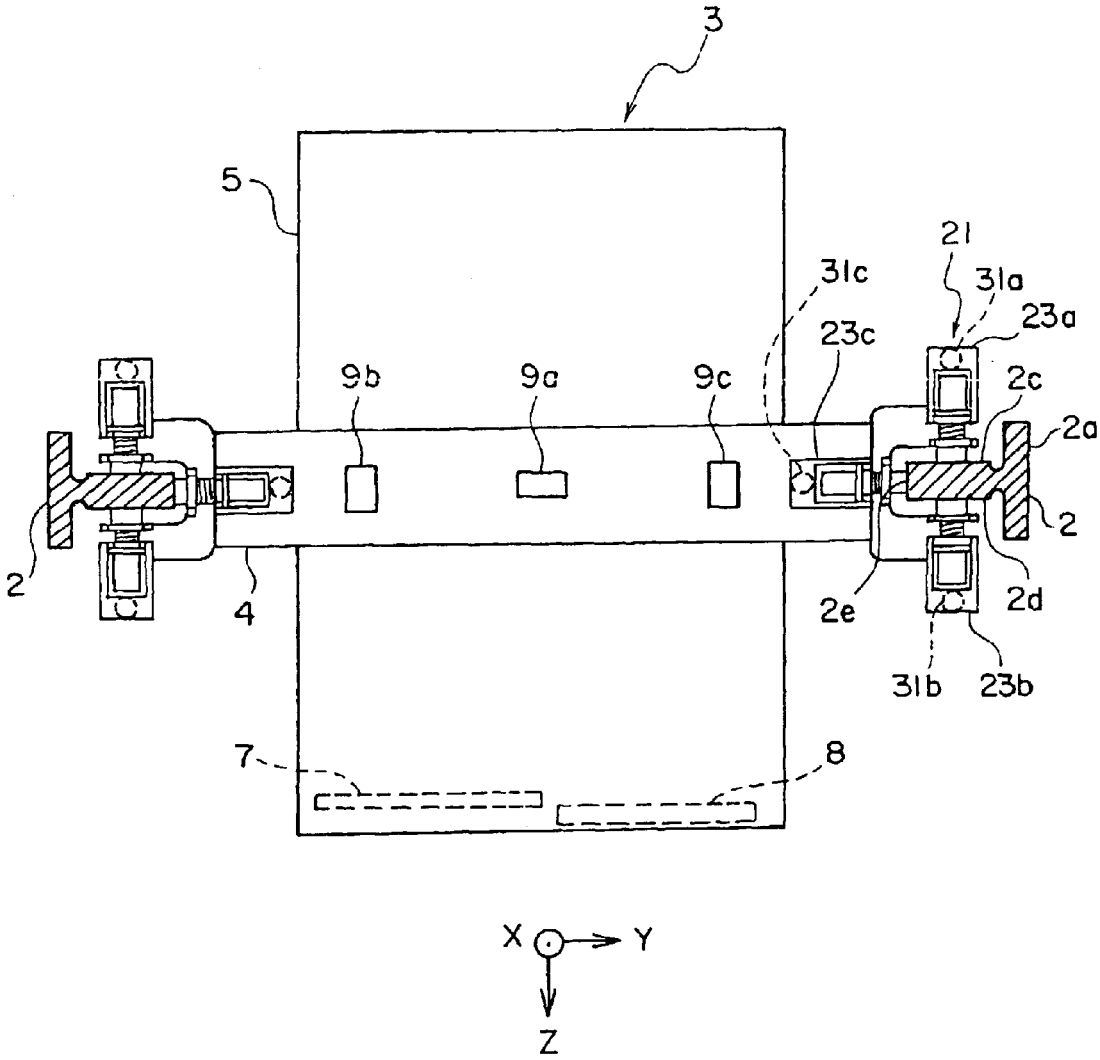
FIG. 2 is a plan view of the elevator of FIG. 1.

FIG. 1 is a front view showing a main portion of an elevator according to Embodiment 1 of this invention, and FIG. 2 is a plan view of the elevator of FIG. 1.

In the drawings, a pair of guide rails 2 with a T-shaped section are arranged in parallel in a hoistway 1. A car 3 is suspended in the hoistway 1 by a main cable (not shown), and is raised and lowered along the guide rails 2 by a drive device (not shown).

Further, the car 3 has a car frame 4, a cab 5 supported by the car frame 4, and a plurality of rubber vibration isolators 6 arranged between the car frame 4 and the cab 5. A car door 7 is provided in the cab 5. Further, a control board 8 is mounted to a side wall surface of the cab 5. It is also possible for the control board 8 to be mounted in the car frame 4.

First through third acceleration sensors 9*a* through 9*c* are mounted to the upper end portion of the car frame 4. Fourth through sixth acceleration sensors 9*d* through 9*f* are mounted to the lower end portion of the car frame 4. Any vibration of the car frame 4 in the width direction of the car 3 (the Y-axis direction in the drawing) is detected by the first and fourth acceleration sensors 9*a* and 9*d* mounted at the center of the car frame 3. Any vibration in the depth direction of the car 3 (the Z-axis direction in the drawing) is detected by the second, third, fifth, and sixth acceleration sensors 9*b*, 9*c*, 9*e*, and 9*f* arranged on either side of the first and fourth acceleration sensors 9*a* and 9*d*.

The guide rails 2 have installation-mounting portions 2*a* fixed to the wall portions (not shown) of the hoistway 1 and guide portions 2*b* extending perpendicularly from the installation-mounting portions 2*a*. Each guide portion 2*b* has first and second guide surfaces 2*c* and 2*d* for guiding the car 3 in the depth direction, and a third guide surface 2*e* for guiding the car 3 in the width direction.

At each of the four corners of the car frame 4, there is mounted a roller guide main body 21 adapted to be engaged with the first through third guide surfaces 2*c*, 2*d*, and 2*e*. Each roller guide main body 21 has a mounting plate 22 fixed to the car frame 4, a first roller assembly 23*a* fixed to the car frame 4, and second and third roller assemblies 23*b* and 23*c* fixed to the mounting plate 22.

Figure 3:
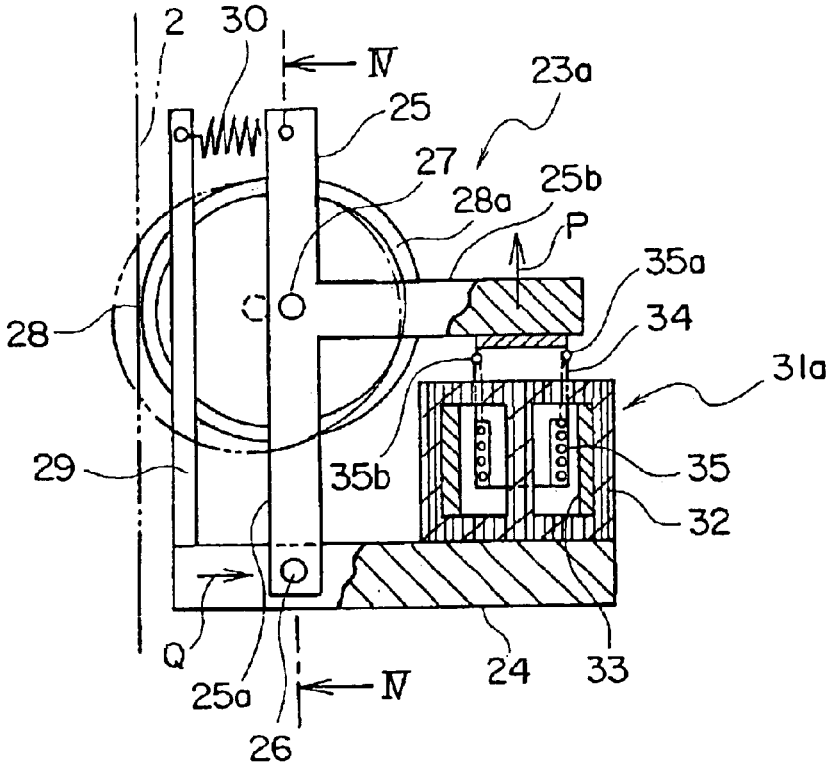
FIG. 3 is a side view, partially in section, of a roller assembly of FIG. 1.
Figure 4:
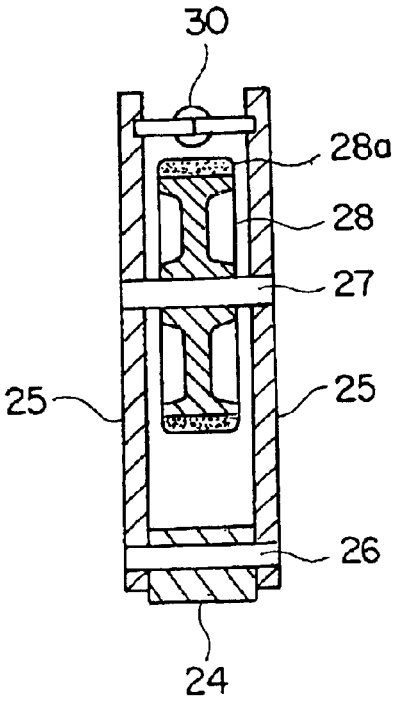
FIG. 4 is a sectional view taken along the line IV—IV of FIG. 3.

FIG. 3 is a side view showing the first roller assembly 23*a* partially in section, and FIG. 4 is a sectional view taken along the line IV—IV of FIG. 3. In the drawings, a base 24 is fixed to the mounting plate 22. A pair of T-shaped rotating members 25 opposed to each other are rotatably connected to the base 24. Each rotating member 25 has a roller support portion 24*a* whose lower end portion is rotatably connected to the base 24 through the intermediation of a pin 26 and a connecting portion 25*b* extending perpendicularly from the roller support portion 25*a*.

A shaft 27 is provided in the middle portion of the pair of roller support portions 25*a*. The rotating members 25 support a roller 28 (guide member) rotatable around the shaft 27. In the outer periphery of the roller 28, there is provided a hard synthetic rubber tread 28*a*. A pair of spring support members 29 is provided upright on the base 24. The spring support members 29 are arranged on either side of the roller 28 with a space therebetween so as to avoid interference with the roller 28.

Between the upper end portion of each spring support member 29 and the upper end portion of each roller support portion 25*a*, there is provided a tension spring 30 (urging means) for urging the roller 28 toward the guide rail 2. When it is not in contact with the guide rail 2, the roller 28 is urged by the tension spring 30 so as to be moved to the position indicated by the broken line.

The roller assembly 23*a* has the base 24, the rotating members 25, the pin 26, the shaft 27, the roller 28, the spring support members 29, and the tension spring 30.

Mounted on the base 24 is a first actuator 31*a* for adjusting the force with which the roller 28 is pressed against the guide rail 2. The first actuator 31*a* has a yoke 32 fixed to the base 24, a permanent magnet 33 fixed to the yoke 32, a bobbin 34 inserted into the yoke 32, and a coil 35 wound around the bobbin 34 and opposed to the permanent magnet 33.

The upper end portion of the bobbin 34 is connected to the connecting portions 25*b* of the rotating members 25 supporting the roller 28. The coil 35 has a pair of terminals 35*a* and 35*b*.

The second and third roller assemblies 23*b* and 23*c* have a structure similar to that of the first roller assembly 23*a*. Further, mounted on the second and third roller assemblies 23*b* and 23*c* are second and third actuators 31*b* and 31*c* having a structure similar to that of the first actuator 31*a*.

Figure 5:
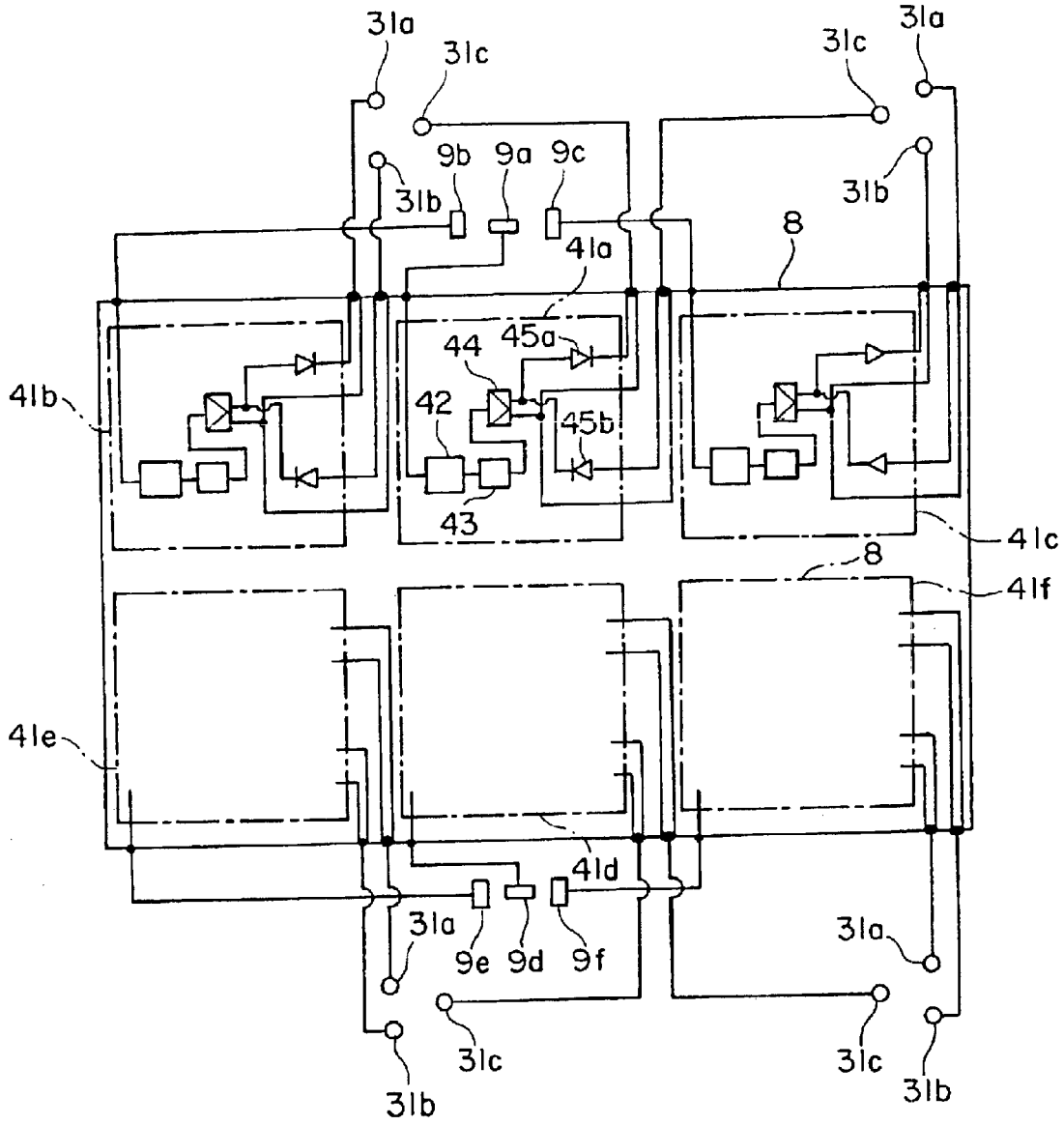
FIG. 5 is a circuit diagram showing a part of the circuits of the control board of the elevator of FIG. 1.

Next, FIG. 5 is a circuit diagram showing a part of the circuits of the control board 8 of FIG. 1. Detection signals from the first through sixth acceleration sensors 9*a* through 9*f* are processed by first through sixth controllers 41*a* through 41*f* in the control board 8. The actuators 31*a* through 31*c* are controlled by the corresponding controllers 41*a* through 41*f*. Each of the controllers 41*a* through 41*f* controls a pair of actuators 31*a* and 31*b* (or 31*c* and 31*c*) causing forces to be applied to the rollers 28 in opposite directions.

The first through third controllers 41*a* through 41*c* are in correspondence with the acceleration sensors 9*a* through 9*c* and the actuators 31*a* through 31*c* arranged on the upper portion of the car frame 4. The fourth through sixth controllers 41*d* through 41*f* are in correspondence with the acceleration sensors 9*d* through 9*f* and the actuators 31*a* through 31*c* arranged on the lower portion of the car frame 4.

Each of the controllers 41*a* through 41*f* has a signal processing circuit 42, a correction circuit 43, a current amplification device 44, and a pair of diodes 45*a* and 45*b*. The signal processing circuits 42 receive detection signals from the acceleration sensors 9*a* through 9*f*, perform computation processing to restrain acceleration, and output processing signals. The correction circuits 43 correct loss voltage due to the diodes 45*a* and 45*b*.

The current amplification devices 44 amplify and adjust signals such that the actuators 31*a* through 31*c* generate electromagnetic force needed in restraining acceleration. The diodes 45*a* and 45*b* supply the current output from the current amplification devices 44 to the corresponding actuators 31*a* through 31*c*.

Figure 6:
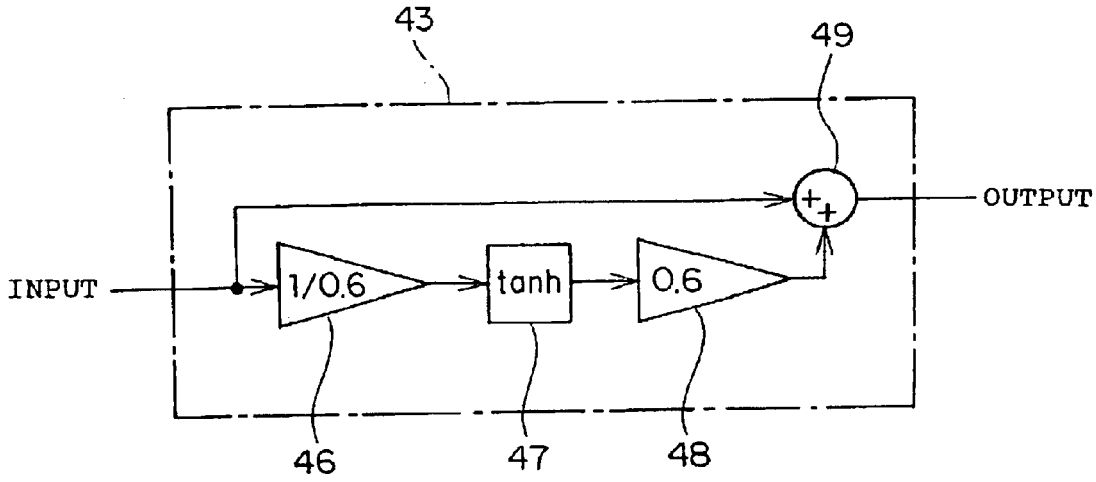
FIG. 6 is a circuit diagram showing a correction circuit in the control board of FIG. 5.

FIG. 6 is a circuit diagram showing one of the correction circuits 43 of FIG. 5. The correction circuit 43 has a first operational amplifier 46, a hyperbolic tangent arithmetic circuit 47, a second operational amplifier 48, and an adder 49. The computation method for the correction circuits 43 will be described specifically below.

Next, the operation of the device will be described. In FIG. 3, when electric current is caused to flow through the coil 35 in a direction regulated by the diodes 45*a* and 45*b*, an upward electromagnetic force is applied to the bobbin 34, and the connecting portions 25*b* of the rotating members 25 receive a force in the direction indicated by an arrow P, whereby the roller 28 is pressed against the guide rail 2. However, since the guide rail 2 is secured in position within the hoistway 1, the roller 28 receives a reactive force from the guide rail 2, and the base 24 is pressurized in the direction indicated by an arrow Q.

Since the base 24 is fixed to the car frame 4, the car frame 4 is pressurized in the direction of the arrow Q together with the base 24, thereby restraining vibration of the car 3. The amount of displacement of the car frame 4 varies according to the value of the current supplied to the coil 35.

Figure 7:
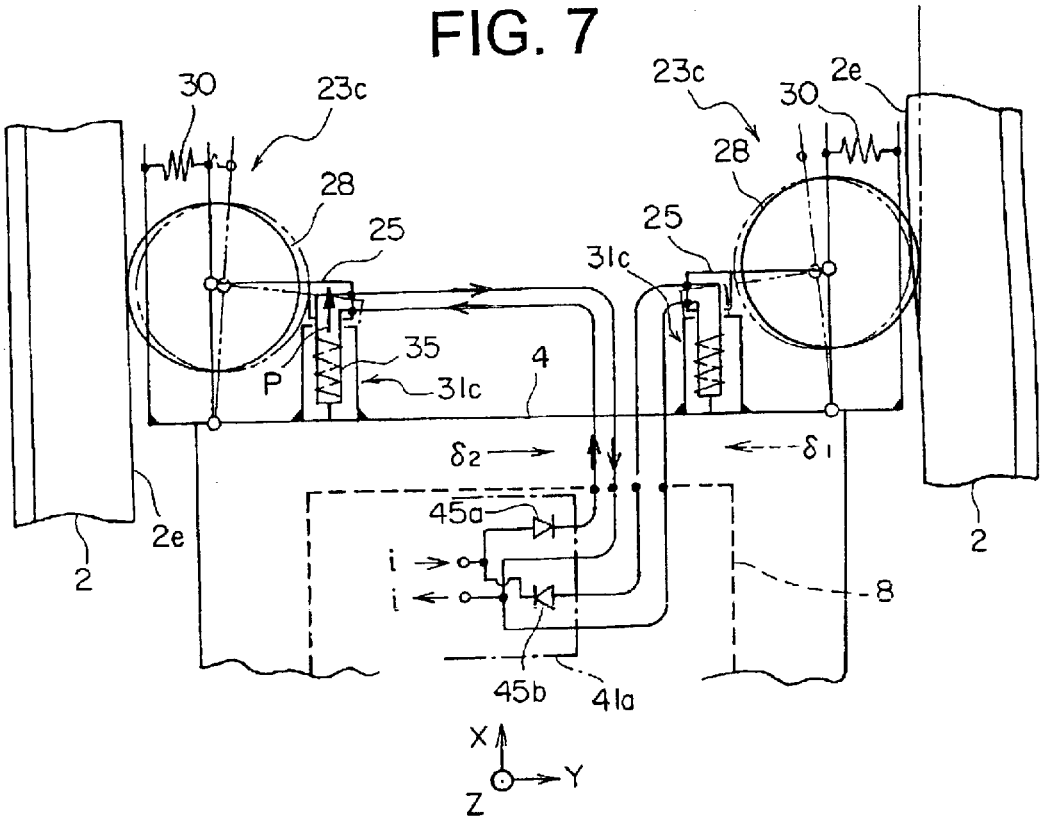
FIG. 7 is an explanatory drawing showing a first example of a vibration restraining method of Embodiment 1.

Next, FIG. 7 is an explanatory drawing showing a first example of a vibration restraining method according to Embodiment 1. In the first example, a part of the right-hand-side guide rail 2 is distorted (or warped) inwardly in the Y-axis direction (to the left in the drawing), and the car 3 is operated so as to be raised.

When the third guide surface 2*e* of the right-hand-side rail 2 is displaced to the left, the roller 28 rolling on that guide surface 2*e* is pressurized to the left, and a horizontal acceleration indicated by an arrow .1 is generated in the car frame 4. At the same time, the roller 28 rolling on the third guide surface 2*e* of the left-hand-side guide rail 2 is pressurized to the right.

At this time, the acceleration in the direction of the arrow .1 is detected by the first acceleration sensor 9*a*, and the detection signal is processed by the first controller 41*a*. In the first controller 41*a*, current i output from the current amplification device 44 undergoes rectification by the diodes 45*a* and 45*b*, and control current is caused to flow back solely to the coil 35 of the left-hand-side actuator 31*c*.

As a result, an upward electromagnetic force P is generated in the left-hand-side actuator 31*c*, and displacement of the roller 28 to the right is prevented. As a result, the left-hand-side roller 28 receives a reactive force from the guide rail 2, and an acceleration in the direction indicated by an arrow .2 is generated in the car frame 4. Due to this acceleration .2, the acceleration .1 due to the distortion of the guide rail 2 is cancelled, and vibration of the car frame 4 is restrained.

Figure 8:
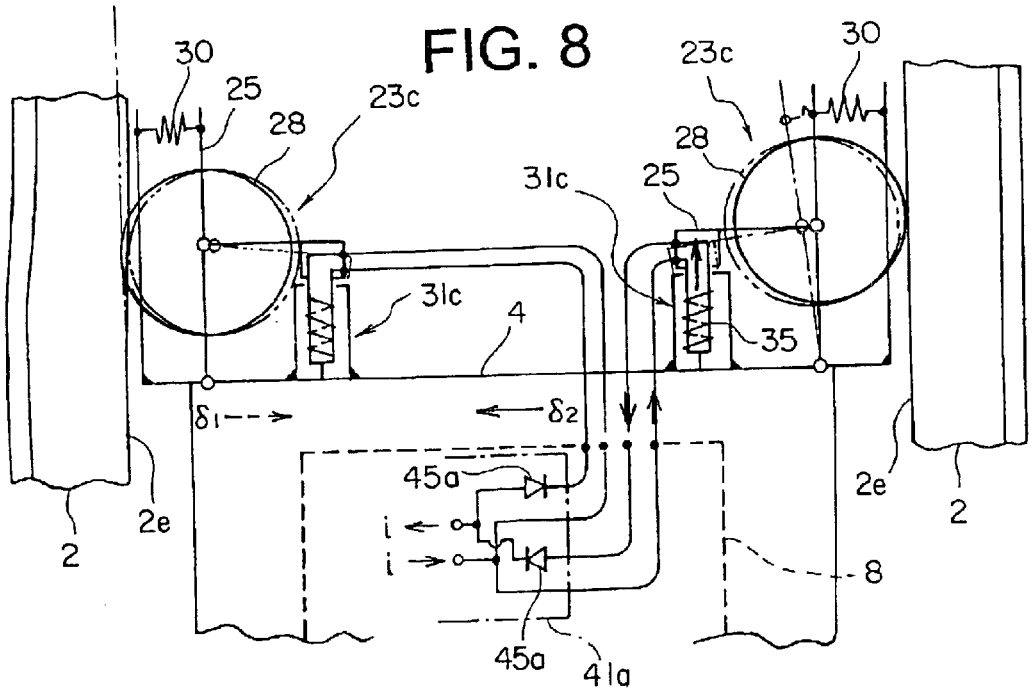
FIG. 8 is an explanatory drawing showing a second example of the vibration restraining method of Embodiment 1.

Next, FIG. 8 is an explanatory drawing showing a second example of a vibration restraining method according to Embodiment 1. In the second example, a part of the left-hand-side guide rail 2 is distorted (or warped) inwardly (to the right in the drawing), and the car 3 is operated so as to be raised.

When the third guide surface 2*e* of the left-hand-side rail 2 is displaced to the right, the roller 28 rolling on that guide surface 2*e* is pressurized to the right, and a horizontal acceleration indicated by an arrow .1 is generated in the car frame 4. At the same time, the roller 28 rolling on the third guide surface 2*e* of the right-hand-side guide rail 2 is pressurized to the left.

At this time, the acceleration in the direction of the arrow .1 is detected by the first acceleration sensor 9*a*, and the detection signal is processed by the first controller 41*a*. In the first controller 41*a*, current i (current which flows in the opposite direction to that of the first example) output from the current amplification device 44 undergoes rectification by the diodes 45*a* and 45*b*, and control current is caused to flow back solely to the coil 35 of the right-hand-side actuator 31*c*.

As a result, an upward electromagnetic force P is generated in the right-hand-side actuator 31*c*, and displacement of the roller 28 to the left is prevented. As a result, the right-hand-side roller 28 receives a reactive force from the guide rail 2, and an acceleration in the direction indicated by an arrow .2 is generated in the car frame 4. Due to this acceleration .2, the acceleration .1 due to the distortion of the guide rail 2 is cancelled, and vibration of the car frame 4 is restrained.

Figure 9:
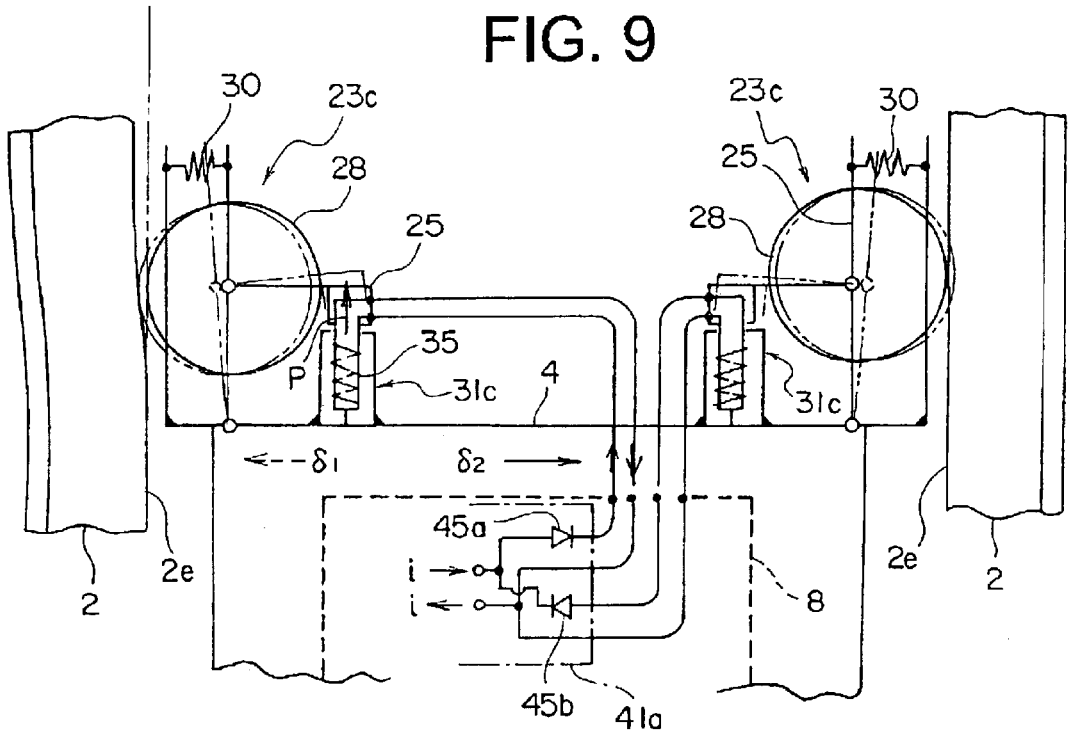
FIG. 9 is an explanatory drawing showing a third example of the vibration restraining method of Embodiment 1.

Next, FIG. 9 is an explanatory drawing showing a third example of a vibration restraining method according to Embodiment 1. In the third example, a part of the left-hand-side guide rail 2 is distorted (or warped) inwardly (to the left in the drawing), and the car 3 is operated so as to be raised.

When the third guide surface 2*e* of the left-hand-side rail 2 is displaced to the left, the roller 28 rolling on that guide surface 2*e* is displaced to the left, whereby the force with which the left-hand-side roller 28 is held in contact with the left-hand-side rail 2 decreases. At this time, a force acting so as to keep in balance the forces with which the right and left rollers 28 are held in contact with the guide rails is applied to the car frame 4, with the result that a leftward acceleration indicated by the arrow .1 is generated in the car frame 4.

At this time, the acceleration in the direction of the arrow .1 is detected by the first acceleration sensor 9*a*, and the detection signal is processed by the first controller 41*a*. In the first controller 41*a*, current i output from the current amplification device 44 undergoes rectification by the diodes 45*a* and 45*b*, and control current is caused to flow back solely to the coil 35 of the left-hand-side actuator 31*c*.

As a result, an upward electromagnetic force P is generated in the left-hand-side actuator 31*c*, and abutment force of the left-hand-side roller 28 is increased. As a result, an acceleration in the direction indicated by an arrow .2 is generated in the car frame 4. Due to this acceleration .2, the acceleration .1 due to the distortion of the guide rail 2 is cancelled, and vibration of the car frame 4 is restrained.

Figure 10:
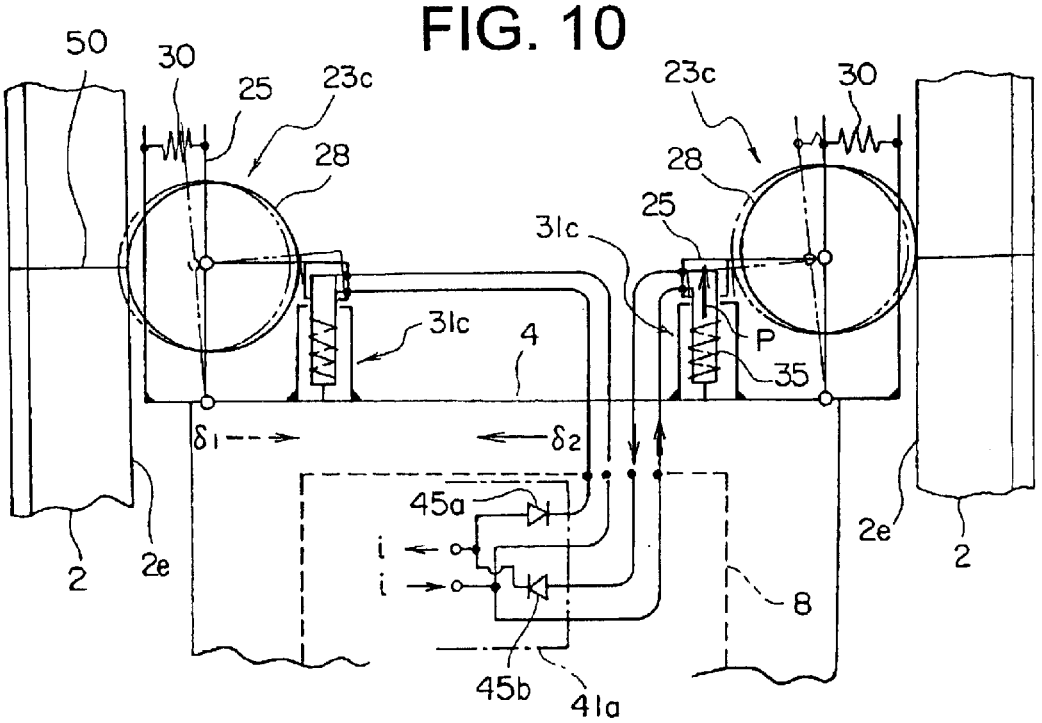
FIG. 10 is an explanatory drawing showing a fourth example of the vibration restraining method of Embodiment 1.

Next, FIG. 10 is an explanatory diagram showing a fourth example of the vibration restraining method according to Embodiment 1. In the fourth example, there is no distortion or warpage in the pair of guide rails 2; an explanation will be given of a case where an acceleration in the direction of the arrow .1 is generated in the car frame 4, for example, by the passengers in the chamber 5 moving or getting together on one side, or by the rollers 28 passing joints 50 of the guide rails 2.

In this case, the acceleration in the direction of the arrow .1 is detected by the first acceleration sensor 9*a*, and from the first controller 41*a*, control current is caused to flow back solely to the coil 35 of the right-hand-side actuator 31*c*.

As a result, an upward electromagnetic force P is generated in the right-hand-side actuator 31*c*, and displacement of the roller 28 to the left is prevented. As a result, the right-hand-side roller 28 receives a reactive force from the guide rail 2, and an acceleration in the direction indicated by an arrow .2 is generated in the car frame 4. Due to this acceleration .2, the acceleration .1 is cancelled, and vibration of the car frame 4 is restrained.

Figure 11:
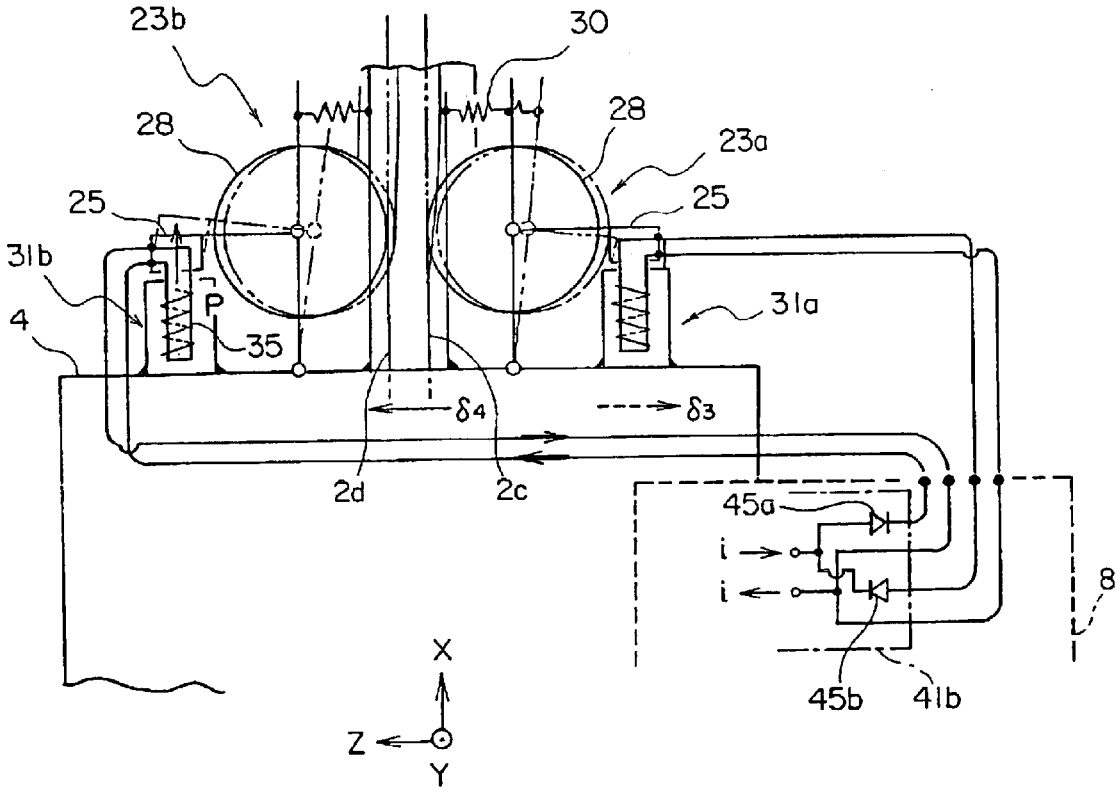
FIG. 11 is an explanatory drawing showing a fifth example of the vibration restraining method of Embodiment 1.

Next, FIG. 11 is an explanatory drawing showing a fifth example of a vibration restraining method according to Embodiment 1. In the fifth example, a part of one guide rail 2 is distorted (or warped) to the backward side in the Z-axis direction in the drawing (to the right), and the car 3 is operated so as to be raised.

In this case, the rollers 28 of the first and second roller assemblies 23*a* and 23*c* are both displaced to the right, and a horizontal acceleration indicated by an arrow .3 is generated in the car frame 4.

At this time, the acceleration in the direction of the arrow .3 is detected by the second acceleration sensor 9*b*, and the detection signal is processed by the second controller 41*b*. In the second controller 41*b*, current i output from the current amplification device 44 undergoes rectification by the diodes 45*a* and 45*b*, and control current is caused to flow back solely to the coil 35 of the second actuator 31*b*.

As a result, an upward electromagnetic force P is generated in the second actuator 31*b*, and the roller 28 is pressed against the second guide surface 2*d*. As a result, the left-hand-side roller 28 receives a reactive force from the guide rail 2, and an acceleration in the direction indicated by an arrow .4 is generated in the car frame 4. Due to this acceleration .4, the acceleration .3 due to the distortion of the guide rail 2 is cancelled, and vibration of the car frame 4 is restrained.

While in the above-described examples vibrations are restrained by means of the roller guide main bodies 21 arranged on the upper portion of the car frame 4, a similar vibration restraining processing can be performed by means of the roller guide main bodies 21 arranged on the lower portion of the car frame 4. Further, also when the car 3 is operated downwards, vibrations are restrained in a similar manner. Further, also when back-and-forth vibration and right-and-left vibration are generated in a complex manner, or when accelerations are simultaneously generated in the upper and lower portions of the car frame 4, the vibrations can be restrained through a combination of the above operations.

This guide device for an elevator uses controllers 41*a* through 41*f* each having a current amplification device 42 and a pair of diodes 45*a* and 45*b*, whereby the number of current amplification devices 42 is reduced by half as compared with that in the prior art, making it possible to produce the device at lower cost. The current amplification device 42, which is formed of a large number of parts and which includes precision parts such as IC chips, is expensive, whereas the diodes 45*a* and 45*b*, which are of a simple structure and involve a small number of parts, are inexpensive. Further, the diodes 45*a* and 45*b* involve a small number of precision parts and are little subject to failure, thus achieving an improvement in terms of reliability.

Further, as shown in FIG. 4, the end portions of the shaft 27 supporting the roller 28 are supported by the rotating members 25, and the rotating members 25 are supported by the end portions of the pin 26, so that, if the roller 28 is pressed against the guide rail 2, twisting of the rotating members 25 and deflection of the shaft 27 are not generated, whereby the outer peripheral surface of the roller 28 can be uniformly held in contact with the guide rail 2, making it possible to stabilize the guiding of the car 3 in its raising and lowering and to restrain vibrations in a stable manner.

Thus, it is possible to restrain vibrations of the car 3 in operation (or at rest on a floor) without any interruption and with accuracy. As a result, it is possible to provide at low cost a high-quality elevator comfortable to ride in even if the car 3 travels at high speed.

Figure 12:
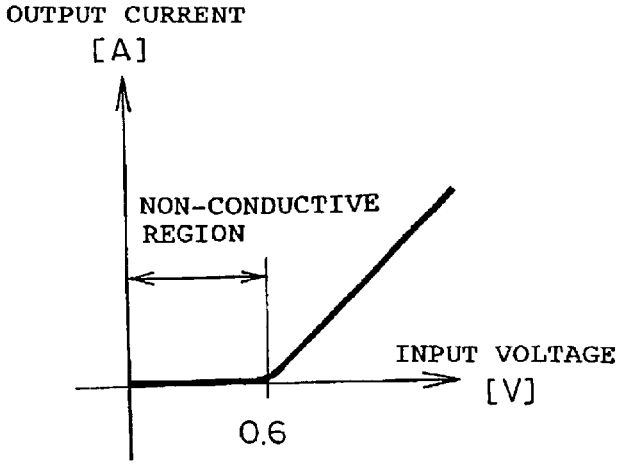
FIG. 12 is a graph showing a relationship between input voltage and output current in a diode of FIG. 5.

Next, FIG. 12 is a graph showing a relationship between input voltage and output current in the diodes 45*a* and 45*b* of FIG. 5. Generally speaking, the diodes 45*a* and 45*b* involve a non-conductive region where no current is output if voltage is applied. In the example shown in FIG. 12, the non-conductive region is the range where the input current is not more than 0.6V; in the non-conductive region, any input voltage is turned into loss voltage.

Thus, when the acceleration generated in the car frame 4 is minute, and the voltage applied to the diodes 45*a* and 45*b* is a voltage within the non-conductive region, it is impossible to restrain the vibration.

In view of this, in Embodiment 1, a correction circuit (filter) 43 for correcting any loss voltage of the diodes 45*a* and 45*b* is provided in each of the controllers 41*a* through 41*f*. In these correction circuits, the following computation is conducted:

$$y=x+n.\ \tan h(x/n.)$$

where x is input voltage [V]; y is output voltage [V]; n is the number of diodes connected in series to the coil within a loop for an actuator; and . is the threshold voltage [V] of a diode.

In the above equation, a voltage loss of n. is generated with respect to the total application voltage E0 (=input voltage x), and the voltage E (=output voltage y) applied to the coil is approximated as follows:

$$E=0(E0<n.),\ \text{or}\ E0-n.\ (E0>n.).$$

Figure 13:
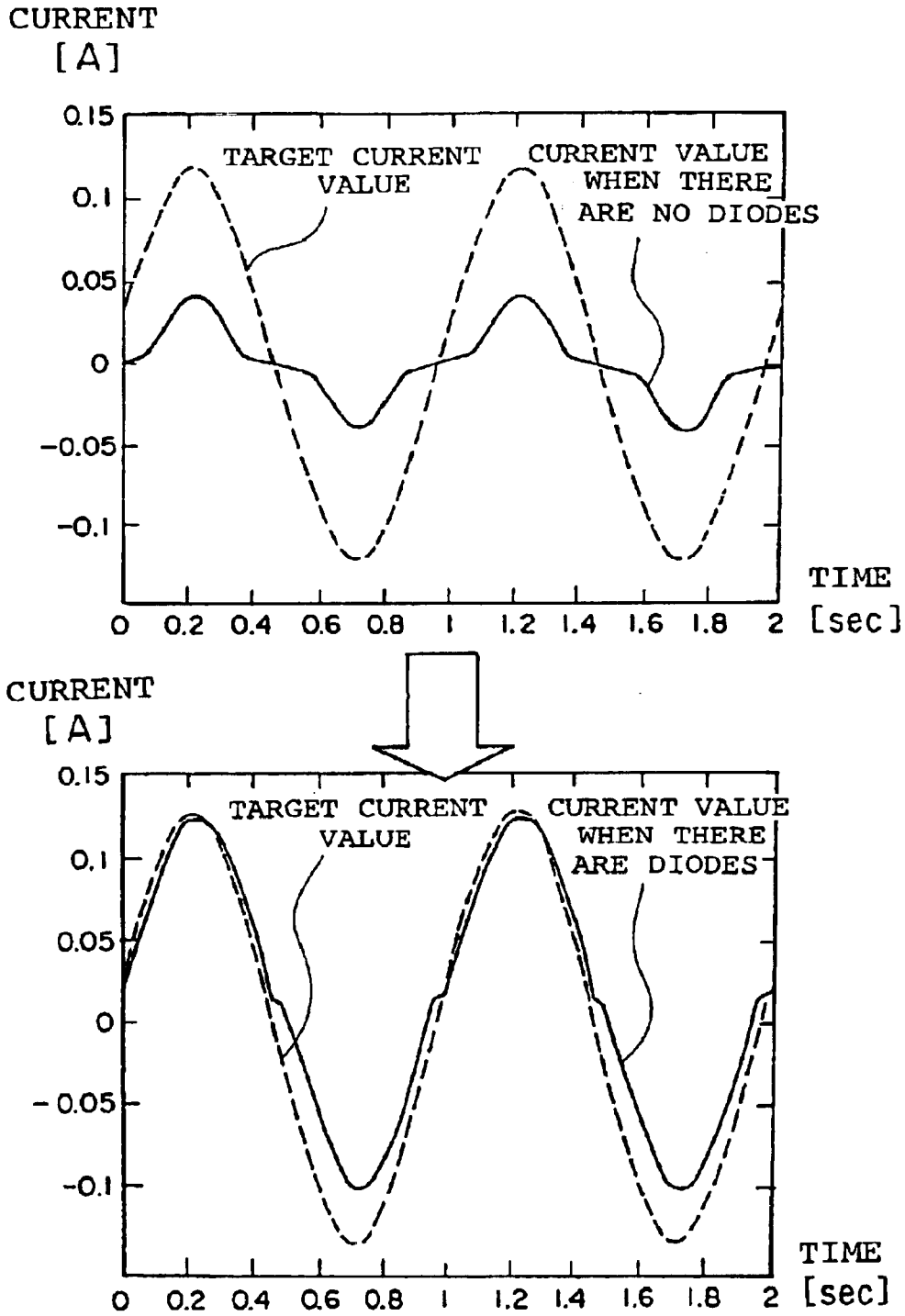
FIG. 13 is an explanatory diagram showing variation in current value due to the correction circuit shown in FIG. 6.

Thus, to apply a desired voltage Ew [V] (the target current value in FIG. 13) to the coil, it is necessary for the command voltage Ei when Ew is positive to be determined as follows: Ei=Ew+n. When Ew is negative, it is necessary to determine the Ei as follows: Ei=Ew−n. To avoid discontinuity when Ew=0, Ei is derived as follows: Ei=Ew+n.tanh (Ei/n.).

In Embodiment 1, n=1, and .=0.6 V, so that the correction is performed by the following equation:

$$y=x+0.6 \tan h(x/0.6).$$

The threshold voltage . of a diode is determined by the characteristics of the diode itself and the temperature. Thus, in a case where the temperature varies to an extreme degree, when . is a constant, there is a danger of the accuracy in vibration restraint deteriorating.

In this connection, the actuators 31*a* through 31*c* are driven by the current amplification devices 44 using a sine wave of a fixed voltage and a fixed frequency, and the acceleration of the car frame 4 at that time is detected by the acceleration sensors 9*a* through 9*f*. When the acceleration detected is lower than a reference value corresponding to the normal state, the threshold voltage . is increased until the acceleration becomes equal to the reference value. Conversely, when the acceleration is higher than the reference value, the threshold voltage . is decreased until the acceleration becomes equal to the reference value. That is, by comparing the acceleration with the reference value, it is possible to obtain a threshold value . in conformity with the temperature.

Figure 15:
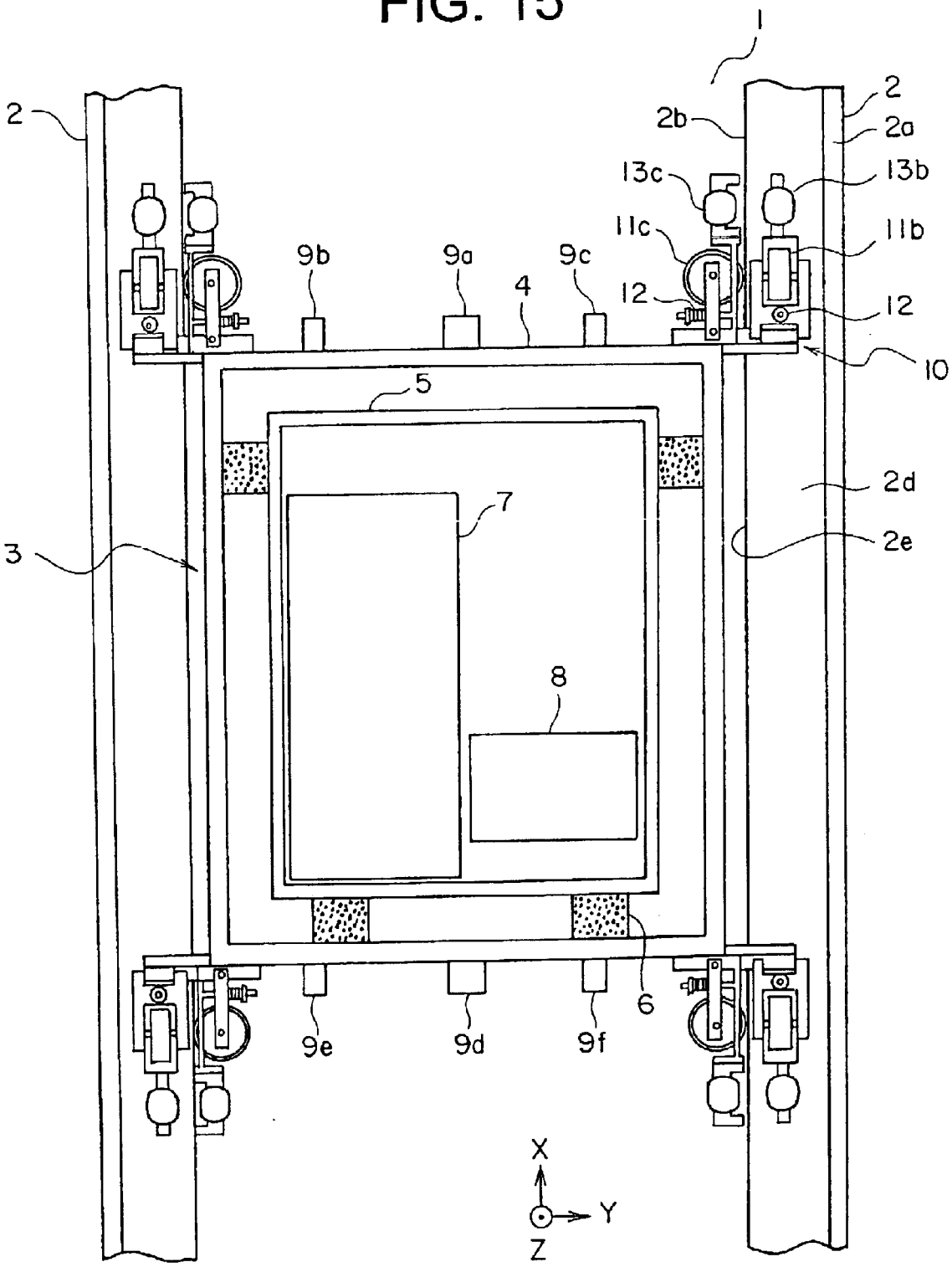
FIG. 15 is a front view showing a main portion of a conventional elevator.
Figure 16:
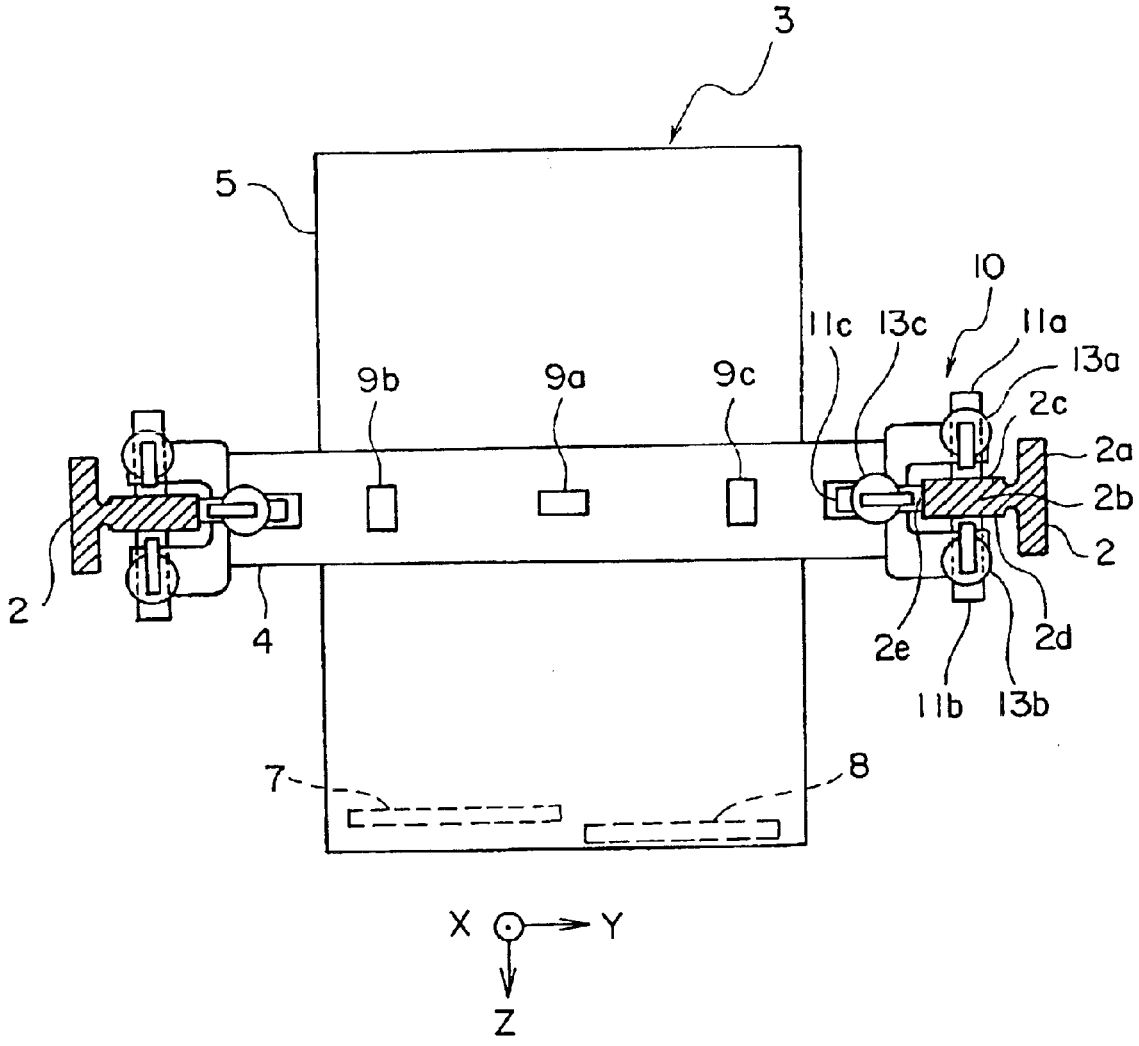
FIG. 16 is a plan view of the elevator of FIG. 15.
Figure 17:
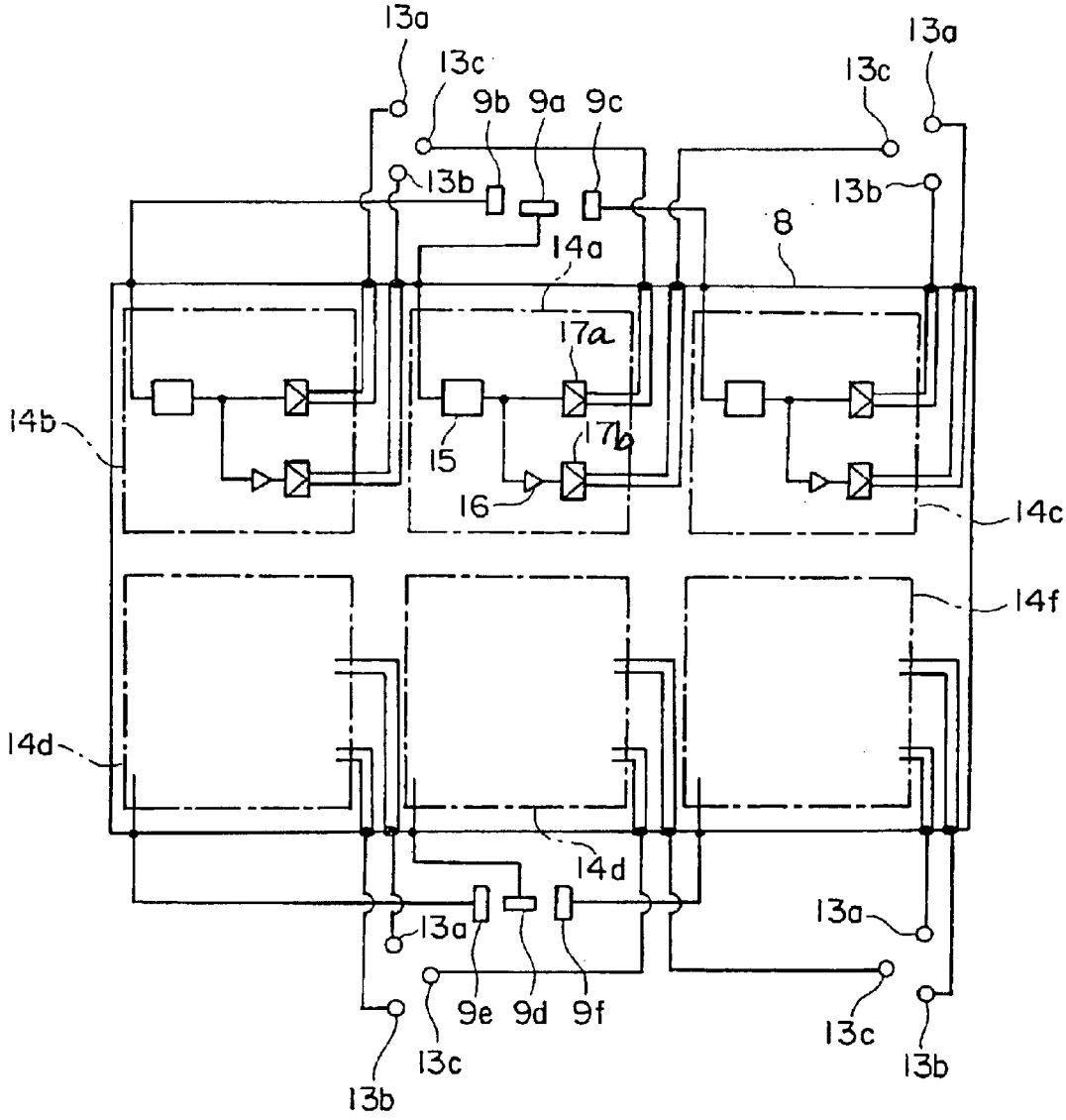
FIG. 17 is a circuit diagram showing a part of the circuits of the control board of the elevator of FIG. 15.

By performing the above loss voltage correction for the diodes 45*a* and 45*b*, it is possible, as shown in FIG. 15, to output current i approximately equal to the target current needed for ideal vibration restraining to the coils 35 of the corresponding actuators 31*a* through 31*c*, thereby making it possible to achieve an improvement in accuracy in vibration restraint.

Embodiment 2

Figure 14:
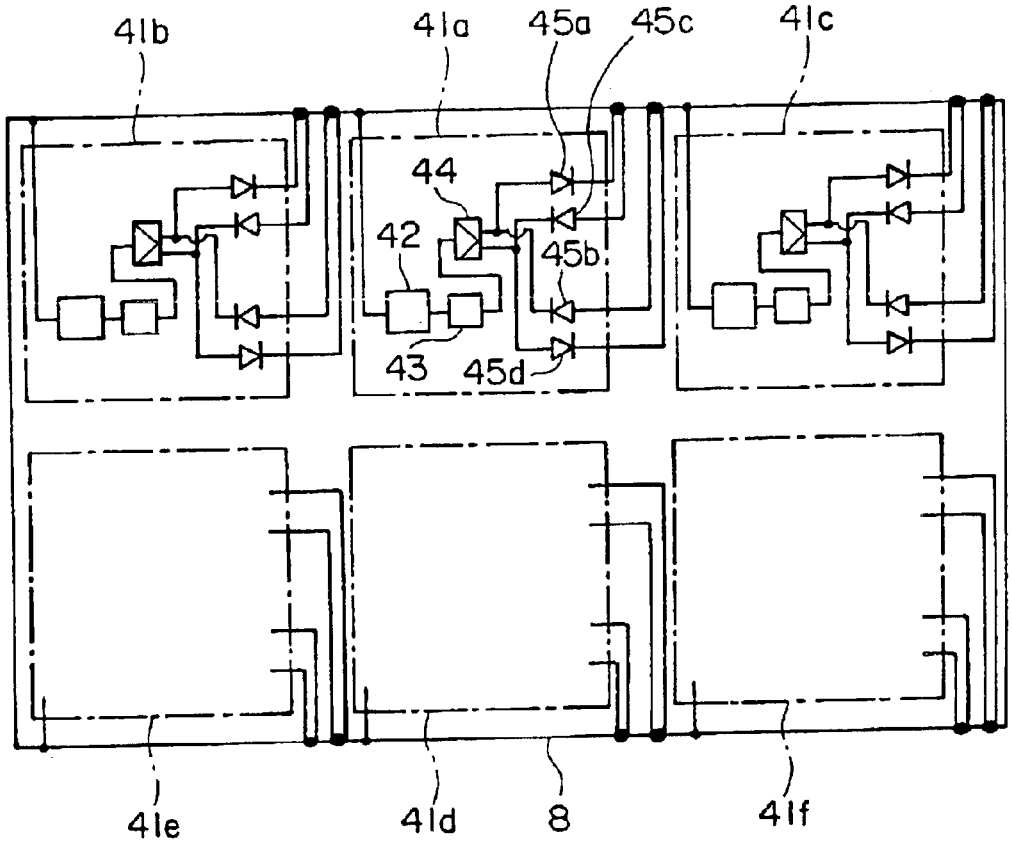
FIG. 14 is a circuit diagram showing a main portion of a guide device for an elevator according to Embodiment 2 of this invention.

FIG. 14 is a circuit diagram showing a main portion of a guide device for an elevator according to Embodiment 2 of this invention. In the drawing, each of the controllers 41*a* through 41*f* has a signal processing circuit 42, a correction circuit 43, a current amplification device 44, and four diodes 45*a* through 45*d*. That is, in a circuit for driving a single actuator 31*a*, 31*b*, or 31*c*, two diodes 45*a* and 45*c* (or 45*b* and 45*d*) are connected in series with the coil 35 therebetween.

In the correction circuit 43 of Embodiment 2, n=2 and .=0.6 V, so that the computation for correction is as follows:

$$y=x+1.2 \tan h(x/1.2)$$

Apart from this, the construction of this embodiment is the same as that of Embodiment 1.

In this guide device, if failure occurs in one of the diodes 45*a* through 45*d*, it is possible to maintain the elevator function with the remaining diodes, thereby achieving an improvement in terms of reliability.

While in Embodiments 1 and 2 the acceleration sensors 9*a* through 9*f* are arranged on the upper and lower portions of the car frame 4, it is also possible to provide the acceleration sensors solely on either the upper or lower portion of the car frame 4, thereby achieving a reduction in cost.

However, providing the acceleration sensors 9*a* through 9*f* and the actuators 31*a* through 31*c* on both the upper and lower portions of the car frame 4 is advantageous in that it is then also possible to cope with acceleration in a turning direction in a vertical plane. Further, when the acceleration sensors 9*a* through 9*f* and the actuators 31*a* through 31*c* are provided solely on the lower portion of the car frame 4, compared to the case where they are provided solely on the upper portion of the car frame 4, it is possible to more effectively restrain the vibrations of the car floor on which the passengers stand, making it possible to reduce the vibrations felt by the passengers.

Further, while in Embodiments 1 and 2 the roller main body 21 having the roller 28 is used, this invention is also applicable to a guide device using a sliding shoe as the guide member.

What is claimed is:

1. A guide device for an elevator engaged with a pair of guide rails, each guide rail having first and second guide surfaces for guiding a car in a car depth direction and a third guide surface for guiding the car in a car width direction, for guiding traveling of the car, said guide device comprising:

a plurality of guide members mounted on the car and abutting the first, second, and third guide surfaces;

a plurality of urging means located between the car and said guide members and pressing said guide members against the guide rails;

a plurality of actuators mounted in the car and adjusting a force with which said guide members are pressed against the guide rails;

a plurality of acceleration sensors mounted on the car and detecting accelerations in the car depth direction and the car width direction of the car; and a plurality of controllers for respectively controlling pairs of said actuators, reversing the force applied to said guide members in accordance with information from said acceleration sensors, wherein each controller includes:

a signal processing circuit for receiving detection signals from one of said acceleration sensors and performing computation processing for restraining any acceleration generated in the car;

a current amplification device for amplifying and adjusting signals from said signal processing circuit; and a plurality of diodes respectively coupled between said current amplification devices and respective pairs of said actuators and selectively outputting signals from said current amplification device to said respective pair of said actuators.

2. The guide device for an elevator according to claim 1, wherein said controller further includes a correction circuit correcting for threshold voltage of said diodes.

3. The guide device for an elevator according to claim 2, wherein said correction circuit performs processing so y=x+n.tanh(x/n.), where y is output voltage, x is input voltage, n is number of diodes corresponding to one of said actuators, and x is the threshold voltage of one of said diodes.

4. The guide device for an elevator according to claim 3, wherein a threshold voltage characteristic of said diodes is determined by outputs of said acceleration sensors when said actuators are driven by said current amplification devices.

5. The guide device for an elevator according to claim 1, wherein said guide members are rollers rolling along the guide rails.

6. The guide device for an elevator according to claim 5, including a plurality of roller assemblies mounted on the car, each roller assembly having a base fixed to the car, a pair of rotating members rotatably connected to said base and opposed to each other, a shaft between said pair of rotating members, a roller that is rotatable around said shaft, and spring support members upright on said base, and wherein said urging means includes a tension spring between said spring support members and said rotating members.

* * * * *